US012729916B2

(12) United States Patent
Onaka et al.

(10) Patent No.: US 12,729,916 B2
(45) Date of Patent: Sep. 8, 2026

(54) HEAT EXCHANGER AND AIR-CONDITIONING APPARATUS

(71) Applicant: Mitsubishi Electric Corporation, Tokyo (JP)

(72) Inventors: Yoji Onaka, Tokyo (JP); Rihito Adachi, Tokyo (JP); Nanami Kishida, Tokyo (JP); Tetsuji Saikusa, Tokyo (JP); Yuki Nakao, Tokyo (JP); Atsushi Kibe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 47 days.

(21) Appl. No.: 18/855,012

(22) PCT Filed: Apr. 19, 2022

(86) PCT No.: PCT/JP2022/018182

§ 371 (c)(1),
(2) Date: Oct. 8, 2024

(87) PCT Pub. No.: WO2023/203640

PCT Pub. Date: Oct. 26, 2023

(65) Prior Publication Data

US 2025/0257949 A1 Aug. 14, 2025

(51) Int. Cl.
*F28D 7/16* (2006.01)
*F28F 1/10* (2006.01)

(52) U.S. Cl.
CPC ..... *F28D 7/16* (2013.01); *F28F 1/105* (2013.01)

(58) Field of Classification Search
CPC ..... F28D 7/16; F28D 1/05366; F28F 1/105; F28F 19/006; F28F 2215/04;
(Continued)

(56) References Cited

U.S. PATENT DOCUMENTS

2013/0299142 A1* 11/2013 Yoshioka ..... F28F 17/005 165/151
2017/0082381 A1 3/2017 Sugimura et al.
(Continued)

FOREIGN PATENT DOCUMENTS

EP 0881450 A1 12/1998
FR 3013821 A1 5/2015
(Continued)

OTHER PUBLICATIONS

Extended European Search Report dated May 23, 2025 issued in corresponding European patent application No. 22938443.3, 8pp.
(Continued)

*Primary Examiner* — Nelson J Nieves
(74) *Attorney, Agent, or Firm* — XSENSUS LLP

(57) ABSTRACT

A heat exchanger includes heat transfer tubes and a fin disposed between the heat transfer tubes. The fin includes a fin portion defining a flat surface and one or more heat transfer promoter groups including heat transfer promoters. The heat transfer promoters extend from one adjacent heat transfer tube to the other adjacent heat transfer tube and slope relative to the fin portion. The heat transfer promoters include a first heat transfer promoter disposed most upstream in the air flow direction. A first drain space is provided between the first heat transfer promoter and an air upstream part of the fin portion that is located closest to and upstream of the first heat transfer promoter in the air flow direction. A second drain space is provided between the heat transfer promoters that are adjacent. The first drain space has a larger area than the second drain space.

14 Claims, 8 Drawing Sheets

(58) Field of Classification Search
CPC ..... F28F 2215/08; F28F 2265/06; F28F 2265/22; F28F 17/005; F28F 1/128; F24F 1/0067
See application file for complete search history.

(56) References Cited

U.S. PATENT DOCUMENTS

| | | | | |
|---|---|---|---|---|
| 2020/0103148 | A1* | 4/2020 | Matsumoto | F28D 1/053 |
| 2021/0172686 | A1* | 6/2021 | Tong | F28F 1/424 |
| 2022/0065556 | A1* | 3/2022 | Agata | F28F 17/005 |
| 2023/0101157 | A1 | 3/2023 | Adachi et al. | |
| 2024/0302114 | A1* | 9/2024 | Onaka | F28F 1/128 |
| 2025/0044033 | A1* | 2/2025 | Yatsuyanagi | F25B 13/00 |

FOREIGN PATENT DOCUMENTS

| | | | | | |
|---|---|---|---|---|---|
| JP | S56-158785 | U | | 11/1981 | |
| JP | H01111964 | U | | 7/1989 | |
| JP | H10-220977 | A | | 8/1998 | |
| JP | 2010-025482 | A | | 2/2010 | |
| JP | 2011-127793 | A | | 6/2011 | |
| JP | 2015-183908 | A | | 10/2015 | |
| JP | 2020051627 | A | * | 4/2020 | F28F 1/128 |
| JP | 2020-133991 | A | | 8/2020 | |
| JP | 2021-110511 | A | | 8/2021 | |
| KR | 20030090467 | A | | 11/2003 | |
| WO | 2018/154806 | A1 | | 8/2018 | |
| WO | 2021/234964 | A1 | | 11/2021 | |

OTHER PUBLICATIONS

International Search Report and Written Opinion mailed on May 31, 2022, received for PCT Application PCT/JP2022/018182, filed on Apr. 19, 2022, 10 pages including English Translation.

Notice of Reasons for Refusal mailed on Feb. 21, 2023, received for JP Application 2022-571190, 14 pages including English Translation.

Notice of Reasons for Refusal mailed on May 23, 2023, received for JP Application 2022-571190, 8 pages including English Translation.

Office Action dated Jul. 16, 2026 issued in corresponding European patent application No. 22938443.3, 5pp.

* cited by examiner

HEAT EXCHANGER AND AIR-CONDITIONING APPARATUS

CROSS-REFERENCE TO RELATED APPLICATION

This application is a national stage application, pursuant to 35 U.S.C. § 371, of International Patent Application No. PCT/JP2022/018182, filed Apr. 19, 2022, the entire contents of which are incorporated herein by reference.

TECHNICAL FIELD

The present disclosure relates to a heat exchanger and an air-conditioning apparatus.

BACKGROUND ART

Corrugated-fin and tube heat exchangers are in widespread use. This type of heat exchanger includes multiple flat heat transfer tubes connected between a pair of headers through which refrigerant passes and a corrugated fin disposed between the multiple flat heat transfer tubes.

A gas passes as a flow between the flat heat transfer tubes, between which the corrugated fin is disposed. In such a heat exchanger, a surface temperature of at least either the flat heat transfer tubes or the corrugated fin may be at or below the freezing point of water. As the surface temperature drops, moisture in the air near a surface condenses into water. As the surface temperature further drops to or below the freezing point of water, the water freezes. Some heat exchangers include fin portions having slits to drain water so that water deposited on the surfaces of the fin portions can be drained through the slits (refer to Patent Literature 1, for example).

CITATION LIST

Patent Literature

Patent Literature 1: Japanese Unexamined Patent Application Publication No. 2015-183908

SUMMARY OF INVENTION

Technical Problem

As described above, a related-art heat exchanger has a structure to drain water deposited on the surface of a corrugated fin. However, the corrugated fin needs to have a large opening area to drain condensate water. This results in a decrease in heat transfer area of the corrugated fin, causing a decrease in heat transfer performance.

In response to the above issue, it is an object of the present disclosure to provide a heat exchanger that can reduce a decrease in heat transfer area with enhanced drainage performance to reduce a decrease in heat transfer performance and an air-conditioning apparatus.

Solution to Problem

A heat exchanger according to an embodiment of the present disclosure includes a plurality of heat transfer tubes spaced in a direction orthogonal to an air flow direction and a corrugated fin disposed between the plurality of heat transfer tubes. The corrugated fin includes a fin portion defining a flat surface and one or more heat transfer promoter groups each including a plurality of heat transfer promoters. The plurality of heat transfer promoters extend from one of the plurality of heat transfer tubes that are adjacent to the other one of the plurality of heat transfer tubes that are adjacent and slope relative to the fin portion. The plurality of heat transfer promoters include a first heat transfer promoter disposed most upstream in the air flow direction. A first drain space is provided between the first heat transfer promoter and an air upstream part of the fin portion that is located closest to and upstream of the first heat transfer promoter in the air flow direction. A second drain space is provided between the heat transfer promoters that are adjacent. The first drain space has a larger area than the second drain space when viewed in a direction perpendicular to the fin portion.

Advantageous Effects of Invention

According to the embodiment of the present disclosure, the area of the first drain space is larger than that of the second drain space when viewed in the direction perpendicular to the fin portion. The first drain space located between the air upstream part of the fin portion and the heat transfer promoter has a relatively large area. This can increase the amount of water drained through the first drain space. The heat exchanger according to the embodiment of the present disclosure can reduce accumulation of condensate water, resulting in enhanced drainage performance. The second drain space located between the adjacent heat transfer promoters has a relatively small area. This can reduce a decrease in heat transfer area of the corrugated fin, thus reducing a decrease in heat transfer performance.

DESCRIPTION OF EMBODIMENTS

An air-conditioning apparatus according to one or more embodiments will be described below with reference to the drawings. Note that the same component is described with the same reference sign in the figures and duplicate explanations are given only when necessary. The present disclosure may encompass all possible combinations of combinable configurations among the configurations described in the following embodiments. Furthermore, note that the relationship between the sizes of components in the figures may differ from that of actual ones. Additionally, note that the forms of components described herein are intended to be illustrative only and the forms of the components are not intended to be limited to those described herein. In particular, combinations of the components are not intended to be limited only to those in the embodiments. A component in one embodiment can be used in another embodiment.

Embodiment 1

Figure 1:
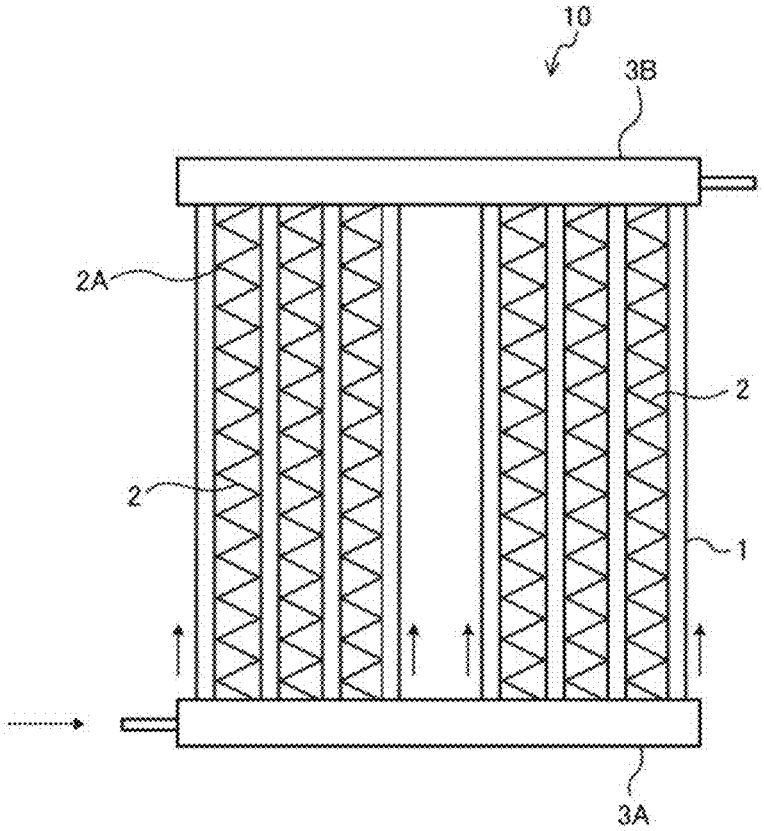
FIG. 1 is a diagram illustrating the configuration of a heat exchanger according to Embodiment 1.

FIG. 1 is a diagram illustrating the configuration of a heat exchanger 10 according to Embodiment 1.

As illustrated in FIG. 1, the heat exchanger 10 according to Embodiment 1 is a corrugated-fin and tube heat exchanger 10 of a parallel-pipe type. The heat exchanger 10 includes multiple flat heat transfer tubes 1, multiple corrugated fins 2, a lower header 3A, and an upper header 3B. In the following description, an up-down direction in the drawing sheet of FIG. 1 is referred to as a height direction of the heat exchanger 10. In addition, a side-to-side direction in the drawing sheet of FIG. 1 is referred to as a horizontal direction. Furthermore, a front-rear direction in the drawing sheet of FIG. 1 is referred to as a depth direction of the heat exchanger 10.

The lower header 3A is connected to another device included in an air-conditioning apparatus by a pipe. The lower header 3A is a tube into or out of which refrigerant, which is a fluid as a heat exchange medium, flows and through which the refrigerant is divided into streams or through which the refrigerant streams join together. The upper header 3B is connected to another device included in the air-conditioning apparatus by a pipe. The upper header 3B is a tube into or out of which the refrigerant, which is a fluid as a heat exchange medium, flows and through which the refrigerant is divided into streams or through which the refrigerant streams join together.

The multiple flat heat transfer tubes 1 are disposed parallel to each other between the lower header 3A and the upper header 3B such that the tubes are perpendicular to the lower header 3A and the upper header 3B. The lower header 3A and the upper header 3B are vertically and separately disposed in the height direction. The lower header 3A allows liquid refrigerant to pass therethrough. The upper header 3B allows gaseous refrigerant to pass therethrough.

The flat heat transfer tubes 1 are arranged at regular intervals in the horizontal direction such that the flat heat transfer tubes 1 that are adjacent have spacing therebetween. In fabricating the heat exchanger 10 according to Embodiment 1, each flat heat transfer tube 1 is inserted into an insertion hole (not illustrated) in each of the lower header 3A and the upper header 3B and is then brazed and joined to the header. For a brazing filler metal, for example, a filler metal containing aluminum is used.

While the heat exchanger 10 is used as a condenser or radiator, high-temperature, high-pressure refrigerant flows through refrigerant passages in the flat heat transfer tubes 1. While the heat exchanger 10 is used as an evaporator or cooler, low-temperature, low-pressure refrigerant flows through the refrigerant passages in the flat heat transfer tubes 1. In FIG. 1, arrows represent a refrigerant flow direction in an operation of the heat exchanger 10 as an evaporator or cooler. The refrigerant flows into either the lower header 3A or the upper header 3B through the pipe (not illustrated) through which the refrigerant is supplied from an external device (not illustrated) to the heat exchanger 10. Once in one of the lower header 3A and the upper header 3B, the refrigerant is distributed to the flat heat transfer tubes 1 and flows through each of the flat heat transfer tubes 1. The flat heat transfer tube 1 exchanges heat between the refrigerant flowing inside the tube and outdoor air, serving as a fluid flowing outside the tube. At this time, the refrigerant transfers heat to or removes heat from the air while flowing through the flat heat transfer tube 1. When the refrigerant has a higher temperature than the air, the refrigerant transfers its heat to the air. When the refrigerant has a lower temperature than the air, the refrigerant removes heat from the air. The refrigerant subjected to heat exchange through the flat heat transfer tube 1 flows into the other one of the lower header 3A and the upper header 3B, and joins the refrigerant that has passed through the other flat heat transfer tubes 1. Then, the refrigerant is recirculated to an external device (not illustrated) through the pipe (not illustrated) connected to the other one of the lower header 3A and the upper header 3B.

The corrugated fins 2 are disposed between the arranged flat heat transfer tubes 1 such that each corrugated fin is located between flat surfaces of the tubes facing each other. Each of the corrugated fins 2 is disposed to increase the area of heat transfer between the refrigerant and the air. The corrugated fin 2 is formed by corrugating a plate. Specifically, the plate is folded into alternating ridges and troughs and is thus formed into an undulating shape or corrugations. The ridges and the troughs of the undulating shape form folds defining top portions 2A of the undulating shape. The corrugated fin 2 includes fin portions 21 (refer to FIG. 2) each defining a flat surface and the top portions 2A each defining a curved surface between the fin portions 21. In Embodiment 1, the top portions 2A of the corrugated fin 2 are arranged in the height direction.

Figure 2:
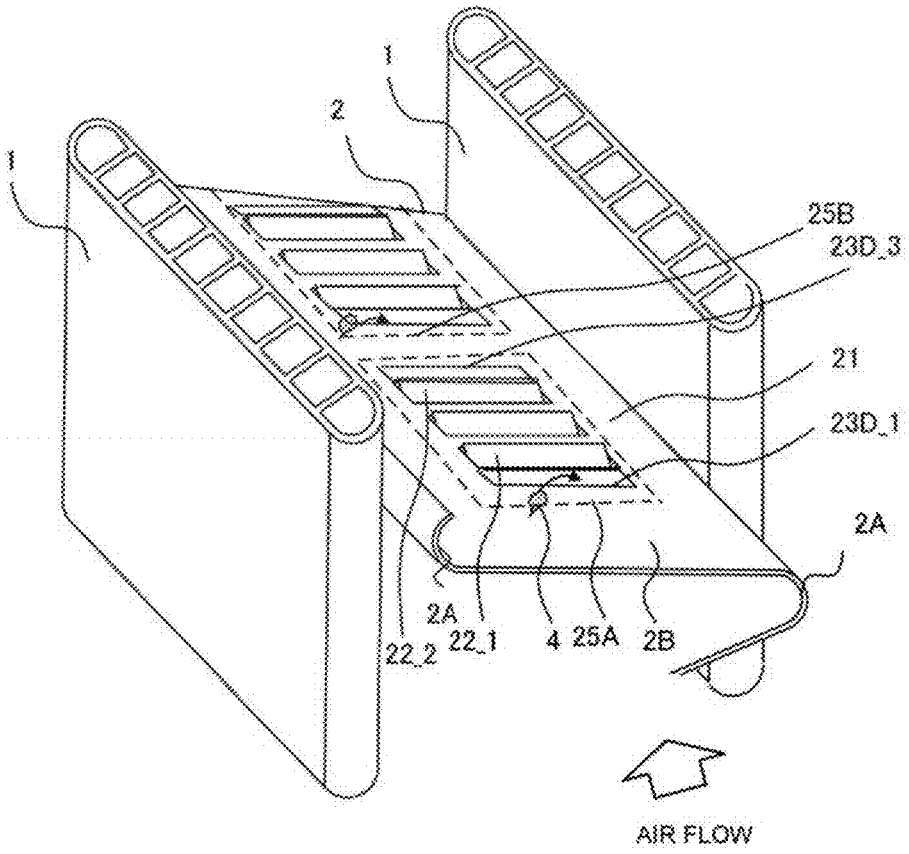
FIG. 2 is a schematic perspective view of flat heat transfer tubes and a corrugated fin in Embodiment 1.
Figure 3:
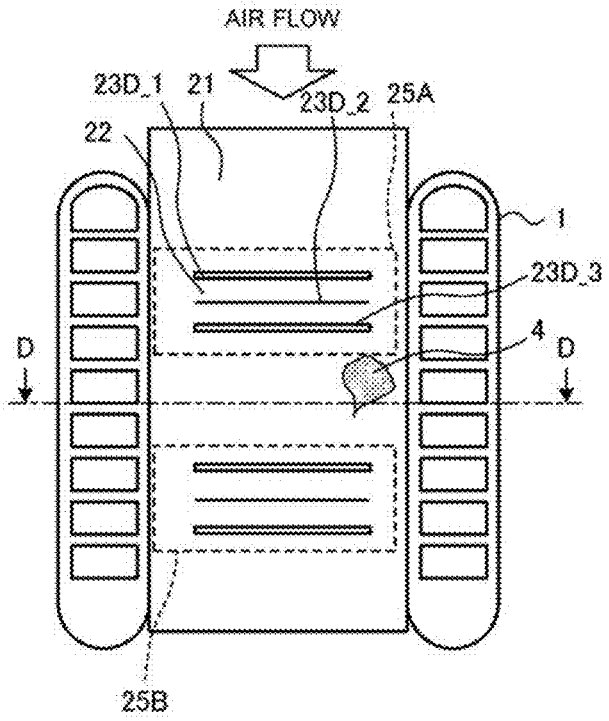
FIG. 3 is a schematic top view illustrating a fin portion of the corrugated fin in Embodiment 1.

FIG. 2 is a schematic perspective view of the flat heat transfer tubes 1 and the corrugated fin 2 in Embodiment 1. FIG. 3 is a schematic top view illustrating the fin portion 21 of the corrugated fin 2 in Embodiment 1. FIG. 3 illustrates a center line D-D that passes through the middle of the fin portion 21 in the depth direction.

The flat heat transfer tubes 1 each have a flat shape in cross-section. A longitudinal direction of the flat shape is parallel to the depth direction as an air flow direction. The flat heat transfer tubes 1 have flat outer surfaces in the depth direction. The heat transfer tubes have curved outer surfaces in a lateral direction of the flat shape that is orthogonal to the longitudinal direction.

The flat heat transfer tubes 1 are multi-hole flat heat transfer tubes each having therein multiple holes, serving as refrigerant passages. In Embodiment 1, the holes of the flat heat transfer tubes 1 serve as refrigerant passages between the lower header 3A and the upper header 3B in FIG. 1 and extend in the height direction.

Each flat heat transfer tube 1 is apart from the next flat heat transfer tube 1 such that the outer surfaces of the tubes in the longitudinal direction of the flat shape face each other.

Each corrugated fin 2 includes an end portion 2B protruding upstream in the air flow direction between the flat heat transfer tubes 1 facing each other. Except for the top portions 2A in the end portion 2B, the top portions 2A of the undulating shape of the corrugated fin 2 are in surface contact with the flat surfaces of the flat heat transfer tubes 1. Contact portions are brazed and joined together with a filler metal. The plate for the corrugated fin 2 is made of, for example, aluminum alloy. The plate is clad with a filler metal layer. The filler metal layer is made of, for example, a filler metal containing aluminum such as an aluminum-silicon alloy. The plate has a thickness of from approximately 30 to approximately 200 μm.

The fin portions 21 are flat surfaces of ridge sides between the top portions 2A of the corrugated fin 2, or portions between the top portions 2A arranged in the height direction. The fin portions 21 each include louver parts 22, each projecting upward and serving as a heat transfer promoter, and first drain spaces 23D_1.

The louver parts 22 are narrow slats. The louver parts 22 are spaced in the depth direction, which is the air flow direction, in each of the fin portions 21. In other words, the multiple louver parts 22 are arranged along an air flow.

FIG. 2 illustrates condensate water 4 generated on the fin portion 21 and being drained to the first drain spaces 23D_1.

As illustrated in FIGS. 2 and 3, the fin portion 21 includes a first heat transfer promoter group 25A and a second heat transfer promoter group 25B.

The first heat transfer promoter group 25A is located in a region upstream of the center line D-D of the fin portion 21 in the air flow direction. In FIG. 3, the first heat transfer promoter group 25A includes two louver parts 22, the first drain space 23D_1, a second drain space 23D_2, and a third drain space 23D_3. Although FIG. 3 illustrates the two louver parts 22, three louver parts 22 may be provided as illustrated in FIG. 2. Alternatively, four or more louver parts 22 may be provided.

The multiple louver parts 22 include a first louver part 22_1 located most upstream in the air flow direction and a second louver part 22_2 located most downstream in the air flow direction.

The first drain space 23D_1 is provided between the first louver part 22_1 and an air upstream part of the fin portion 21 that is located closest to and upstream of the first louver part 22_1 in the air flow direction. The first drain space 23D_1 is an opening extending through the fin portion 21 and has a rectangular shape as viewed from above in a direction perpendicular to the flat surface of the fin portion 21.

The second drain space 23D_2 is provided between the louver parts 22 that are adjacent. The louver parts 22 in Embodiment 1 are formed by cutting the plate forming the fin portion 21 and raising cut parts. The second drain space 23D_2 is a space between the raised cut parts of the fin portion 21.

The third drain space 23D_3 is provided between the second louver part 22_2 and a downstream part of the fin portion 21 that is located closest to and downstream of the second louver part 22_2 in the air flow direction. The third drain space 23D_3 is an opening extending through the fin portion 21 and has a rectangular shape as viewed from above in the direction perpendicular to the flat surface of the fin portion 21.

The first drain space 23D_1 has an area larger than that of the second drain space 23D_2 when viewed in the direction perpendicular to the fin portion 21. Furthermore, in Embodiment 1, the third drain space 23D_3 has an area larger than that of the second drain space 23D_2 when viewed in the direction perpendicular to the fin portion 21.

The second heat transfer promoter group 25B is located in a region downstream of the center line D-D of the fin portion 21 in the air flow direction. In FIG. 3, the second heat transfer promoter group 25B includes two louver parts 22, the first drain space 23D_1, the second drain space 23D_2, and the third drain space 23D_3. Although FIG. 3 illustrates the two louver parts 22, three louver parts 22 may be provided as illustrated in FIG. 2. Alternatively, four or more louver parts 22 may be provided.

The multiple louver parts 22 include the first louver part 22_1 located most upstream in the air flow direction and the second louver part 22_2 located most downstream in the air flow direction.

The first drain space 23D_1 is provided between the first louver part 22_1 and an air upstream part of the fin portion 21 that is located closest to and upstream of the first louver part 22_1 in the air flow direction. The first drain space 23D_1 is an opening extending through the fin portion 21 and has a rectangular shape as viewed from above in the direction perpendicular to the flat surface of the fin portion 21.

The second drain space 23D_2 is provided between the louver parts 22 that are adjacent.

The third drain space 23D_3 is provided between the second louver part 22_2 and a downstream part of the fin portion 21 that is located closest to and downstream of the second louver part 22_2 in the air flow direction. The third drain space 23D_3 is an opening extending through the fin portion 21 and has a rectangular shape as viewed from above in the direction perpendicular to the flat surface of the fin portion 21.

The first drain space 23D_1 has an area larger than that of the second drain space 23D_2 when viewed in the direction perpendicular to the fin portion 21. Furthermore, in Embodiment 1, the third drain space 23D_3 has an area larger than that of the second drain space 23D_2 when viewed in the direction perpendicular to the fin portion 21.

Figure 4:
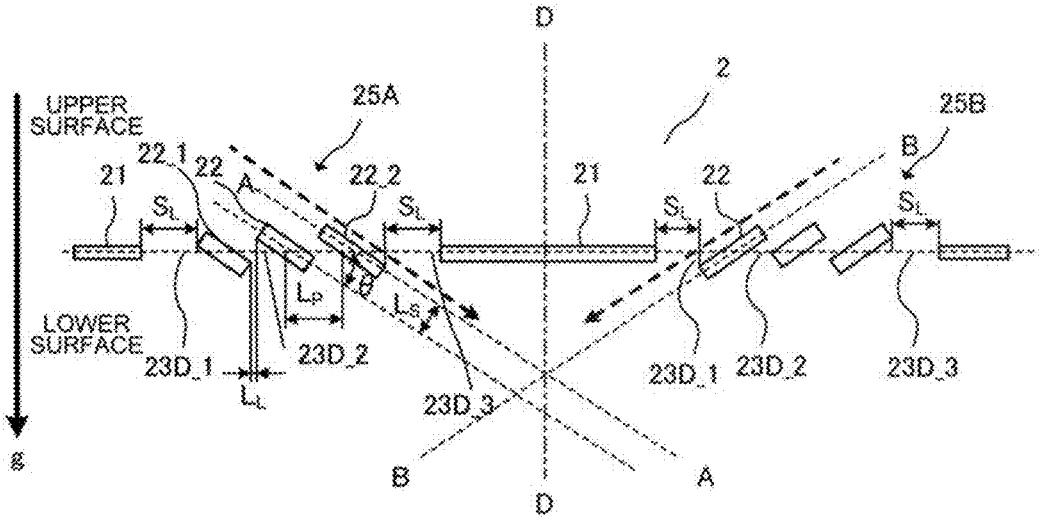
FIG. 4 is a schematic longitudinal sectional view of the fin portion of the corrugated fin in Embodiment 1.

FIG. 4 is a schematic longitudinal sectional view of the fin portion 21 of the corrugated fin 2 in Embodiment 1. FIG. 4 illustrates an example of the first heat transfer promoter group 25A including three louver parts 22 arranged in the air flow direction and further illustrates an example of the second heat transfer promoter group 25B including three louver parts 22 arranged in the air flow direction.

FIG. 4 illustrates the following reference signs and parameters.

- A-A: An imaginary line representing a slope of the louver part 22 of the first heat transfer promoter group 25A relative to the fin portion 21
- B-B: An imaginary line representing a slope of the louver part 22 of the second heat transfer promoter group 25B relative to the fin portion 21
- $L_L$ denotes a distance between the louver parts 22 that are adjacent in a plane along the fin portion 21. In the example of FIG. 4, $L_L$ denotes a distance between a lower end of one of the adjacent louver parts 22 and an upper end of the other louver part 22 in a direction along the fin portion 21.
- $L_P$ denotes a distance between the centers of the adjacent louver parts 22 in the plane along the fin portion 21.
- $L_s$ denotes a distance of a gap between the adjacent louver parts 22.
- θ denotes an inclination angle of the louver part 22 relative to the fin portion 21.

$S_L$ in an upstream region of the first heat transfer promoter group 25A in the air flow direction denotes a distance between the first louver part 22_1 and the air upstream part of the fin portion 21 located closest to and upstream of the first louver part 22_1 in the air flow direction. In other words, $S_L$ in the upstream region of the first heat transfer promoter group 25A in the air flow direction denotes a dimension of the first drain space 23D_1 when viewed in the direction perpendicular to the flat surface of the fin portion 21.

$S_L$ in a downstream region of the first heat transfer promoter group 25A in the air flow direction denotes a distance between the second louver part 22_2 and the downstream part of the fin portion 21 located closest to and downstream of the second louver part 22_2. In other words, $S_L$ in the downstream region of the first heat transfer promoter group 25A in the air flow direction denotes a dimension of the third drain space 23D_3 when viewed in the direction perpendicular to the flat surface of the fin portion 21.

$L_L$ in the first heat transfer promoter group 25A denotes a distance between the adjacent louver parts 22 in the first heat transfer promoter group 25A. In other words, $L_L$ in the first heat transfer promoter group 25A denotes a dimension of the second drain space 23D_2 in the air flow direction when viewed in the direction perpendicular to the fin portion 21.

The dimension $S_L$ in the downstream region of the first heat transfer promoter group 25A in the air flow direction is longer than the dimension $L_L$ in the first heat transfer promoter group 25A.

$S_L$ in an upstream region of the second heat transfer promoter group 25B in the air flow direction denotes a distance between the first louver part 22_1 and the air upstream part of the fin portion 21 located closest to and upstream of the first louver part 22_1. In other words, $S_L$ in the upstream region of the first heat transfer promoter group 25A in the air flow direction denotes a dimension of the first drain space 23D_1 when viewed in the direction perpendicular to the flat surface of the fin portion 21. $S_L$ in a downstream region of the second heat transfer promoter group 25B in the air flow direction denotes a distance between the second louver part 22_2 and the downstream part of the fin portion 21 located closest to and downstream of the second louver part 22_2 in the air flow direction. In other words, $S_L$ in the downstream region of the first heat transfer promoter group 25A in the air flow direction denotes a dimension of the third drain space 23D_3 when viewed in the direction perpendicular to the flat surface of the fin portion 21.

$L_L$ in the second heat transfer promoter group 25B denotes a distance between the adjacent louver parts 22 in the second heat transfer promoter group 25B. In other words, $L_L$ in the second heat transfer promoter group 25B denotes a dimension of the second drain space 23D_2 in the air flow direction when viewed in the direction perpendicular to the fin portion 21.

The dimension $S_L$ in the downstream region of the second heat transfer promoter group 25B in the air flow direction is longer than the dimension $L_L$ in the second heat transfer promoter group 25B.

In the heat exchanger 10 according to Embodiment 1, each of the first drain space 23D_1 and the third drain space 23D_3, which are larger than the second drain space 23D_2 between the adjacent louver parts 22, is located between a part of the fin portion 21 and the louver part 22 adjacent to the part of the fin portion 21. Therefore, the relationship of $S_L > L_L$ holds.

In the first heat transfer promoter group 25A in FIG. 4, the three louver parts 22 are spaced and arranged parallel to each other. In the first heat transfer promoter group 25A, a gap formed outside each outermost louver part 22 is larger than the gap between the louver parts 22 in the first heat transfer promoter group 25A. In the second heat transfer promoter group 25B, a gap formed outside each outermost louver part 22 is larger than the gap between the louver parts 22 in the second heat transfer promoter group 25B.

A part of the perimeter of the first drain space 23D_1 is defined by an edge of the first louver part 22_1 at the most upstream location. In other words, the first louver part 22_1 and the first drain space 23D_1 adjoin each other without any part or space therebetween. A part of the perimeter of the third drain space 23D_3 is defined by an edge of the second louver part 22_2 at the most downstream location. In other words, the second louver part 22_2 and the third drain space 23D_3 adjoin each other without any part or space therebetween.

In the above description, the first drain space 23D_1 and the third drain space 23D_3 each have a rectangular shape when viewed from above, as illustrated in FIG. 3. The first drain space 23D_1 and the third drain space 23D_3 may have any shape other than a rectangle.

Figure 5:
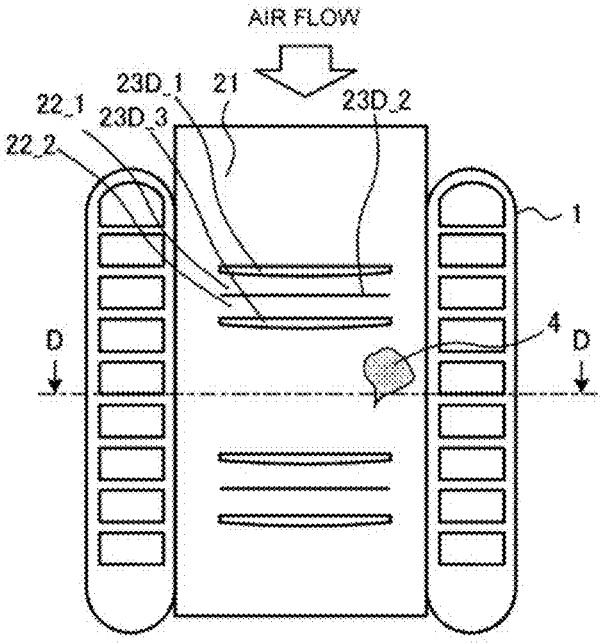
FIG. 5 is a schematic top view illustrating a fin portion of a corrugated fin having a first drain space and a third drain space in Modification of Embodiment 1.

FIG. 5 is a schematic top view illustrating a fin portion 21 of a corrugated fin 2 having a first drain space 23D_1 and a third drain space 23D_3 in Modification of Embodiment 1. As illustrated in FIG. 5, the first drain space 23D_1 and the third drain space 23D_3 each have a shape including a curve when viewed in the direction perpendicular to the fin portion 21. In the example of FIG. 5, the first drain space 23D_1 and the third drain space 23D_3 are D-shaped in outline. The louver part 22 defining the first drain space 23D_1 has a curved edge extending from one flat heat transfer tube 1 to the other flat heat transfer tube 1. This causes the shape of the first drain space 23D_1 to include a curve. In addition, a part of the fin portion 21 defining the third drain space 23D_3 has a curved edge extending from one flat heat transfer tube 1 to the other flat heat transfer tube 1. This causes the shape of the third drain space 23D_3 to include a curve. The curve of each of the first drain space 23D_1 and the third drain space 23D_3 is a curve having a top portion 2A located at the midpoint between the flat heat transfer tubes 1 and protruding in the air flow direction. The first drain space 23D_1 and the third drain space 23D_3 each have an opening area that increases toward the midpoint between the flat heat transfer tubes 1. Although FIG. 5 illustrates the example in which the curve of each of the first drain space 23D_1 and the third drain space 23D_3 protrudes in the air flow direction, the curve may protrude in a direction opposite to the air flow direction.

In a related-art heat exchanger, condensate water 4 on the corrugated fin 2 flows downward through a drain space (second drain space 23D_2 in Embodiment 1) between the louver parts 22. In a path through which the condensate water 4 flows on the corrugated fin 2, the amount of condensate water 4 flowing to the louver part 22 from a part of the fin portion 21 that is adjacent to the louver part 22 in the air flow direction is larger than the amount of condensate water 4 flowing on the louver part 22.

In the heat exchanger 10 according to Embodiment 1, the first drain space 23D_1 is provided between the first louver part 22_1 and the air upstream part of the fin portion 21 located closest to and upstream of the first louver part 22_1 in the air flow direction, and the second drain space 23D_2 is provided between the louver parts 22 that are adjacent. The area of the first drain space 23D_1 is larger than that of the second drain space 23D_2 when viewed in the direction perpendicular to the fin portion 21.

The condensate water 4 on the flat fin portion 21 of the corrugated fin 2 is pressed by an air flow and thus flows from upstream to downstream on the fin portion 21. Then, the condensate water 4 reaches the first drain space 23D_1 located between the first louver part 22_1, serving as a heat transfer promoter located upstream in the air flow direction, and the fin portion 21 and flows downward through the first drain space 23D_1. Since the first drain space 23D_1 has a relatively large area as described in Embodiment 1, most of the condensate water 4 flows downward through the first drain space 23D_1. This results in enhanced drainage of the condensate water 4 on the fin portion 21 of the corrugated fin 2. The term "drainage" as used herein refers to the amount of water drained from the heat exchanger 10 per unit time. Such a relatively large area of the first drain space 23D_1 between the first louver part 22_1 and the adjacent part of the fin portion 21 allows a reduction in accumulation of the condensate water 4 in the first drain space 23D_1, or a bridge of the condensate water 4 between the first louver part 22_1 and the fin portion 21.

Experiments and analysis by the inventors demonstrate that while condensate water 4 drains or flows downward through the gaps between the louver parts 22, a large amount of condensate water 4 is guided from the fin portion 21. This result reveals that the first drain space 23D_1 larger than the second drain space 23D_2 can effectively enhance the drainage. The area of the second drain space 23D_2 located between the louver parts 22 of the corrugated fin 2 is smaller than the area of the first drain space 23D_1. This reduces a decrease in heat transfer area of the corrugated fin 2, thus reducing a decrease in heat transfer performance.

The first drain space 23D_1 is provided in a region that is located upstream in an air flow and in which the air contains a large amount of moisture when the heat exchanger 10 is used under frosting conditions. This increases a frost retention region. In other words, more frost forms around the first drain space 23D_1 and is retained there. Thus, the time it takes for growing frost to block an air passage between the fin portions 21 arranged vertically can be prolonged, resulting in improved resistance to frost.

In the heat exchanger 10 according to Embodiment 1, the multiple louver parts 22 include the second louver part 22_2 located most downstream in the air flow direction.

The third drain space 23D_3 is provided between the second louver part 22_2 and the downstream part of the fin portion 21 located closest to and downstream of the second louver part 22_2 in the air flow direction. The area of the third drain space 23D_3 is larger than that of the second drain space 23D_2 when viewed in the direction perpendicular to the fin portion 21.

The condensate water 4 on the flat fin portion 21 of the corrugated fin 2 is pressed by an air flow and thus flows from upstream to downstream on the fin portion 21. Then, the condensate water 4 reaches the third drain space 23D_3 located between the second louver part 22_2, serving as a heat transfer promoter located downstream in the air flow direction, and the fin portion 21 and flows downward through the third drain space 23D_3. Since the third drain space 23D_3 has a relatively large area as described in Embodiment 1, most of the condensate water 4 flows downward through the third drain space 23D_3. This results in enhanced drainage of the condensate water 4 on the fin portion 21 of the corrugated fin 2. Such a relatively large area of the third drain space 23D_3 between the second louver part 22_2 and the adjacent part of the fin portion 21 allows a reduction in accumulation of the condensate water 4 in the third drain space 23D_3, or a bridge of the condensate water 4 between the second louver part 22_2 and the fin portion 21.

As illustrated in FIG. 5, when each of the first drain space 23D_1 and the third drain space 23D_3 is shaped such that a middle portion of the opening area has a large curvature, such a shape can further enhance the drainage while minimizing a decrease in heat transfer performance of parts of the fin portion 21 that have low fin efficiency. If each of the first drain space 23D_1 and the third drain space 23D_3 is shaped such that the middle portion of the opening area has a larger opening space, such a shape can further enhance the drainage while minimizing a decrease in heat transfer performance.

Embodiment 2

Figure 6:
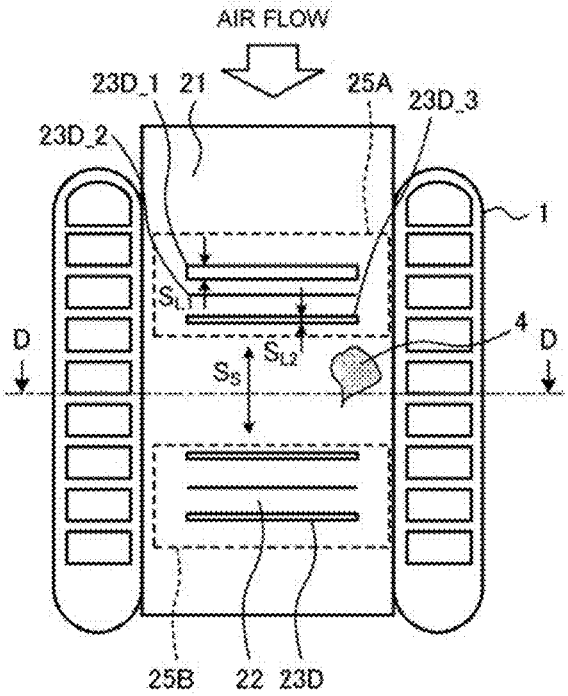
FIG. 6 is a schematic top view illustrating a corrugated fin in Embodiment 2.

FIG. 6 is a schematic top view illustrating a corrugated fin 2 in Embodiment 2. The same elements as those in FIG. 3 are assigned the same reference signs. The following description will focus on a difference from FIG. 3.

In Embodiment 2, as illustrated in FIG. 6, the first drain space 23D_1 in the first heat transfer promoter group 25A has an opening area larger than that of the third drain space 23D_3 in the first heat transfer promoter group 25A.

The sum of opening areas defined by the multiple louver parts 22 in the first heat transfer promoter group 25A is greater than the sum of opening areas defined by the multiple louver parts 22 in the second heat transfer promoter group 25B. The relationship is expressed by $A_1>B_1$ where $A_1$ is the sum of the opening areas defined by the multiple louver parts 22 in the first heat transfer promoter group 25A and $B_1$ is the sum of the opening areas defined by the multiple louver parts 22 in the second heat transfer promoter group 25B. The sum of the opening areas includes the opening areas of the first drain space 23D_1, the second drain space 23D_2, and the third drain space 23D_3.

The heat exchanger 10 provides a large amount of heat exchange in a part of the fin portion 21 that is located upstream in the air flow direction and that has a large difference in temperature between the air and the refrigerant flowing through the flat heat transfer tubes 1. Therefore, more condensate water 4 can be generated upstream in the air flow direction.

In the heat exchanger 10 according to Embodiment 2, the sum of the opening areas of the drain spaces in the first heat transfer promoter group 25A located upstream of the center line D-D of the fin portion 21 in the air flow direction is greater than the sum of the opening areas of the drain spaces in the second heat transfer promoter group 25B located downstream in the air flow direction. Therefore, the heat exchanger 10 according to Embodiment 2 exhibits higher drainage than the heat exchanger 10 according to Embodiment 1.

Furthermore, as illustrated in the first heat transfer promoter group 25A in FIG. 6, the first drain space 23D_1 located upstream in the air flow direction has an opening area larger than that of the third drain space 23D_3 located downstream in the air flow direction. This results in further enhanced drainage.

Embodiment 3

Figure 7:
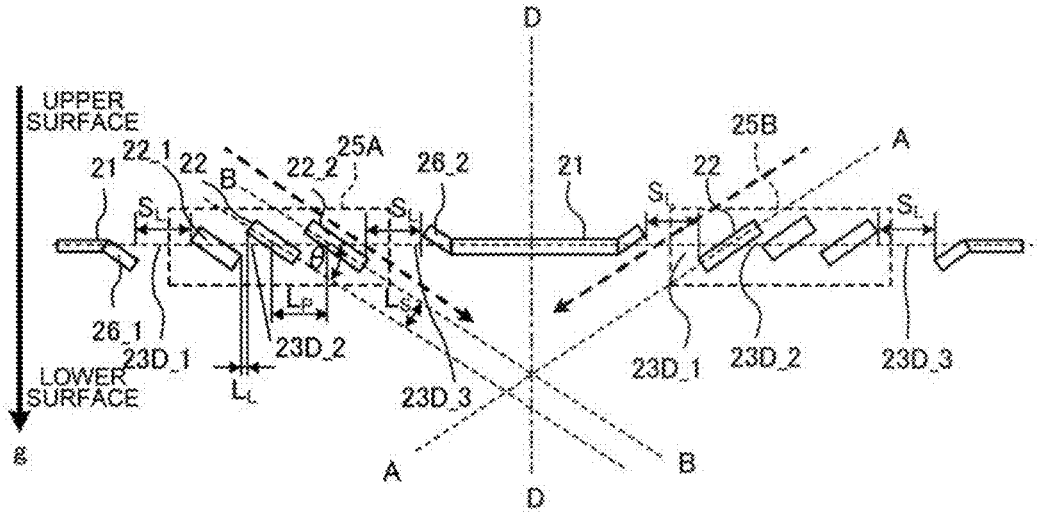
FIG. 7 is a sectional side view of a fin portion of a corrugated fin in Embodiment 3.

FIG. 7 is a sectional side view of a fin portion 21 of a corrugated fin 2 in Embodiment 3. The same elements as those in FIG. 4 are assigned the same reference signs. The following description will focus on differences from FIG. 4.

As illustrated in FIG. 7, the multiple louver parts 22 in the first heat transfer promoter group 25A slope relative to the fin portion 21. An air upstream part of the fin portion 21 that is located closest to and upstream of the first louver part 22_1 in the air flow direction includes a first sloping part 26_1 that slopes parallel to a sloping direction of the first louver part 22_1. A downstream part of the fin portion 21 that is located closest to and downstream of the second louver part 22_2 in the air flow direction includes a second sloping part 26_2 that slopes parallel to a sloping direction of the second louver part 22_2.

The first sloping part 26_1 of the air upstream part of the fin portion 21 located closest to and upstream of the first louver part 22_1 in the air flow direction in the first heat transfer promoter group 25A protrudes to a lower surface of the fin portion 21.

The second sloping part 26_2 of the downstream part of the fin portion 21 located closest to and downstream of the first louver part 22_1 in the air flow direction in the first heat transfer promoter group 25A protrudes to an upper surface of the fin portion 21.

When viewed in the direction perpendicular to the fin portion 21, the first drain space 23D_1 provided between the first sloping part 26_1 and the first louver part 22_1 in the first heat transfer promoter group 25A has an area larger than that of the second drain space 23D_2 provided between the adjacent louver parts 22.

When viewed in the direction perpendicular to the fin portion 21, the third drain space 23D_3 provided between the second sloping part 26_2 and the second louver part 22_2 in the first heat transfer promoter group 25A has an area larger than that of the second drain space 23D_2 provided between the adjacent louver parts 22.

The multiple louver parts 22 in the second heat transfer promoter group 25B slope relative to the fin portion 21. An air upstream part of the fin portion 21 that is located closest to and upstream of the first louver part 22_1 in the air flow direction includes a first sloping part 26_1 that slopes parallel to a sloping direction of the first louver part 22_1. A downstream part of the fin portion 21 that is located closest to and downstream of the second louver part 22_2 in the air flow direction includes a second sloping part 26_2 that slopes parallel to a sloping direction of the second louver part 22_2.

The first sloping part 26_1 of the air upstream part of the fin portion 21 located closest to and upstream of the first louver part 22_1 in the air flow direction in the second heat transfer promoter group 25B protrudes to the upper surface of the fin portion 21.

The second sloping part 26_2 of the fin portion 21 located closest to and downstream of the first louver part 22_1 in the air flow direction in the second heat transfer promoter group 25B protrudes to the lower surface of the fin portion 21.

The first drain space 23D_1 provided between the first sloping part 26_1 and the first louver part 22_1 in the second heat transfer promoter group 25B is larger than the second drain space 23D_2 provided between the adjacent louver parts 22.

The third drain space 23D_3 provided between the second sloping part 26_2 and the second louver part 22_2 in the second heat transfer promoter group 25B is larger than the second drain space 23D_2 provided between the adjacent louver parts 22.

In a heat exchanger 10 according to Embodiment 3, the first sloping parts 26_1 and the second sloping parts 26_2 increase an area that contributes to heat exchange in the corrugated fin 2, thus improving the heat transfer performance of the corrugated fin 2.

The first drain space 23D_1 in the first heat transfer promoter group 25A extending along the slope (in the direction of a thick broken-line arrow in FIG. 7) of the louver parts 22 defines a passage along the slope between the first sloping part 26_1 and the first louver part 22_1. The passage between the first sloping part 26_1 and the first louver part 22_1 serves as a drain path for condensate water 4. This allows enhanced drainage from the corrugated fin 2 as well as improved heat transfer performance, as compared with the configuration without the first sloping part 26_1.

The third drain space 23D_3 extending along the slope (in the direction of a thick broken-line arrow in FIG. 7) of the louver parts 22 defines a large opening with the second sloping part 26_2, as compared with the configuration without the second sloping part 26_2. This allows enhanced drainage from the corrugated fin 2.

Embodiment 4

Figure 8:
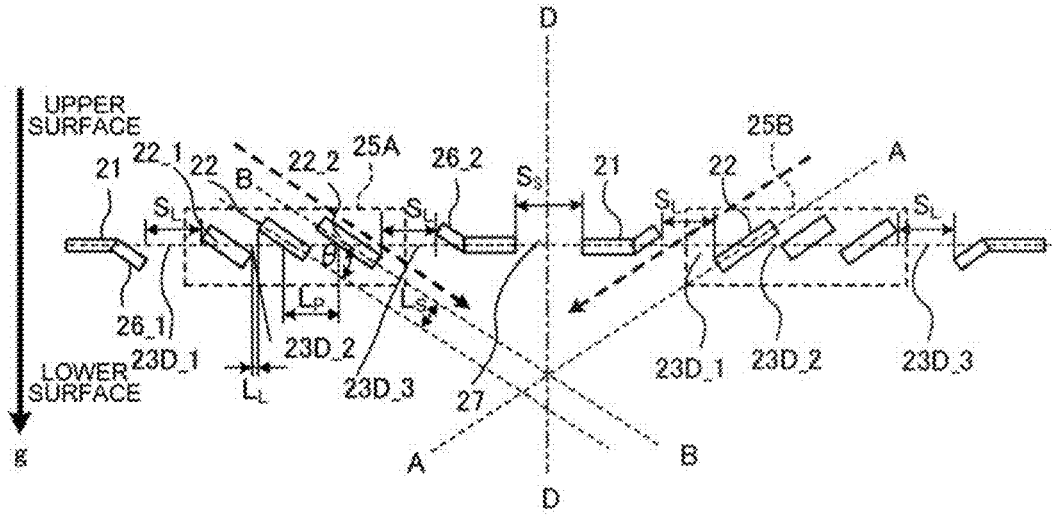
FIG. 8 is a sectional side view of a fin portion of a corrugated fin in Embodiment 4.

FIG. 8 is a sectional side view of a fin portion 21 of a corrugated fin 2 in Embodiment 4. The same elements as those in FIG. 4 are assigned the same reference signs. The following description will focus on a difference from FIG. 4.

A heat exchanger 10 according to Embodiment 4 includes a flat drain slit 27 that is located at substantially the middle of the fin portion 21 in the air flow direction and that serves as a fourth drain space to drain condensate water 4. The flat drain slit 27 is provided between the first heat transfer promoter group 25A and the second heat transfer promoter group 25B.

Although not illustrated in FIG. 8, the multiple fin portions 21 are arranged vertically as seen from FIGS. 1 and 2. The flat drain slits 27 of the respective fin portions 21 are also arranged vertically.

As illustrated in FIG. 8, the louver parts 22 are directed so that the condensate water 4 (not illustrated) can be gathered to the flat drain slit 27 of the fin portion 21 at a lower level than the fin portion 21 including these louver parts 22. In FIG. 8, broken-line arrows each represent the direction of drainage of the condensate water 4. As represented by the broken-line arrows, the condensate water 4 flowing along the surfaces of the louver parts 22 falls toward the flat drain slit 27 of the fin portion 21 at a lower level than these louver parts 22 and then falls downward through the flat drain slit 27. Directing the louver parts 22 in the above-described manner can enhance the drainage of condensate water 4.

Furthermore, the sloping direction of the multiple louver parts 22 in the first heat transfer promoter group 25A relative to the fin portion 21 is opposite, with respect to the flat drain slit 27, to the sloping direction of the multiple louver parts 22 in the second heat transfer promoter group 25B relative to the fin portion 21. This allows the condensate water 4 falling from the first heat transfer promoter group 25A and the condensate water 4 falling from the second heat transfer promoter group 25B to flow toward one flat drain slit 27.

Figure 9:
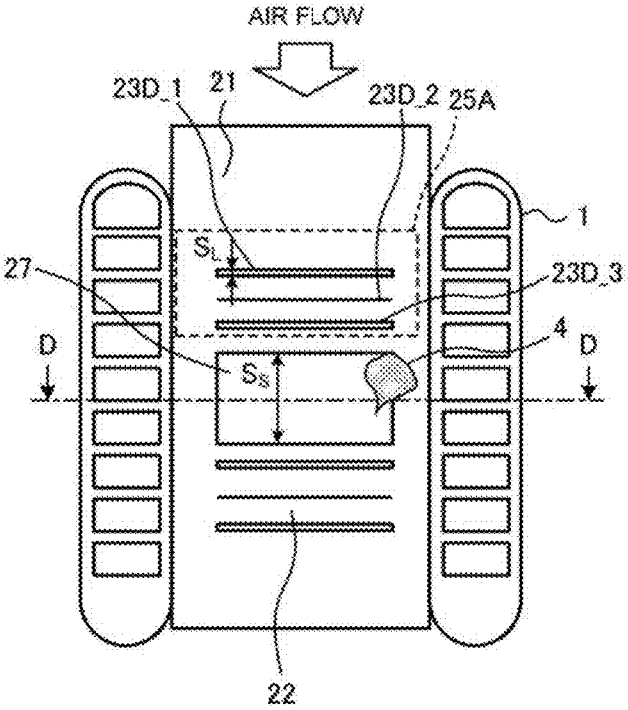
FIG. 9 is a schematic top view illustrating the fin portion of the corrugated fin in Embodiment 4.

FIG. 9 is a schematic top view illustrating the fin portion 21 of the corrugated fin 2 in Embodiment 4. The same elements as those in FIG. 3 are assigned the same reference signs. The following description will focus on a difference from FIG. 3.

As illustrated in FIG. 9, the flat drain slit 27 has an opening area greater than a total opening area of the first heat transfer promoter group 25A. The total opening area of the first heat transfer promoter group 25A is the sum of the opening areas of the first drain space 23D_1, the second drain space 23D_2, and the third drain space 23D_3. The flat drain slit 27 has a dimension Ss in the air flow direction.

Modification

Although FIGS. 8 and 9 illustrate an example in which the flat drain slit 27 is a single rectangular opening, the flat drain slit 27 may include multiple openings.

Figure 10:
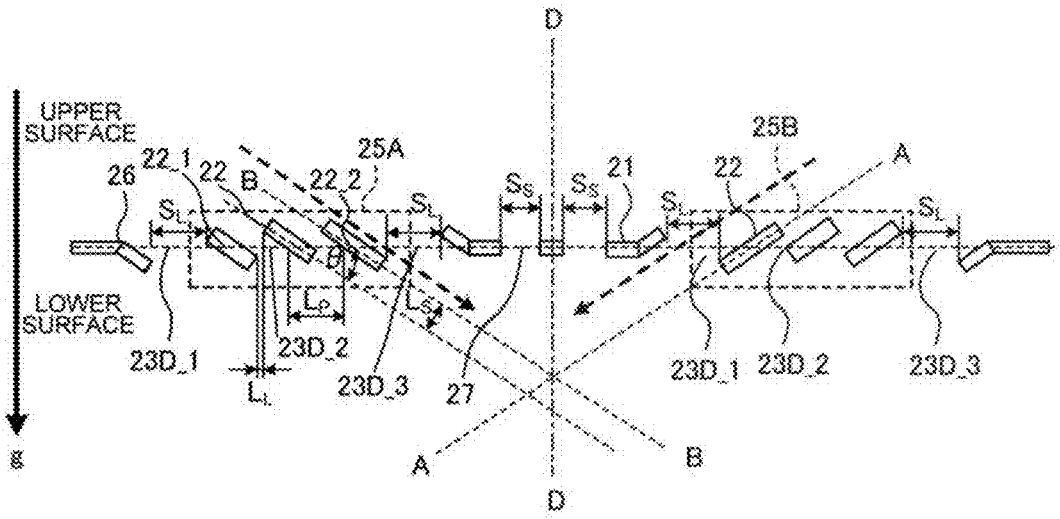
FIG. 10 is a sectional side view of a fin portion of a corrugated fin in Modification of Embodiment 4.
Figure 11:
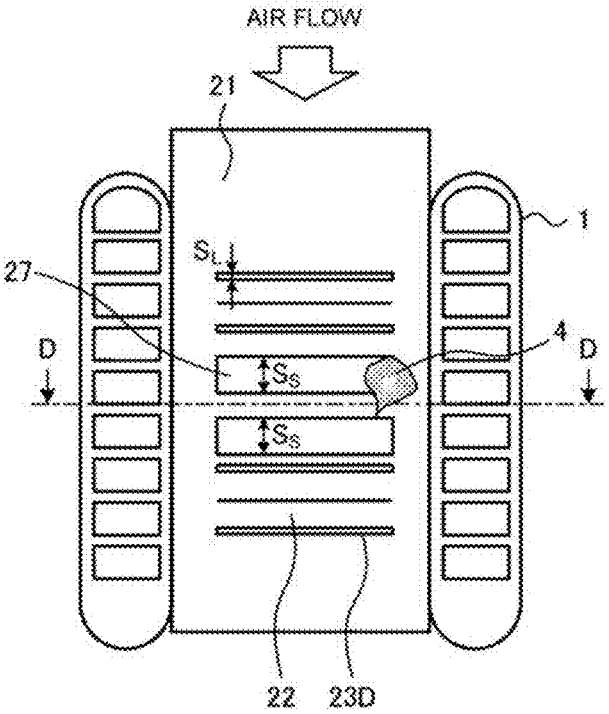
FIG. 11 is a schematic top view illustrating the fin portion of the corrugated fin in Modification of Embodiment 4.

FIG. 10 is a sectional side view of a fin portion 21 of a corrugated fin 2 in Modification of Embodiment 4. The same elements as those in FIG. 4 are assigned the same reference signs. The following description will focus on a difference from FIG. 4. FIG. 11 is a schematic top view illustrating the fin portion 21 of the corrugated fin 2 in Modification of Embodiment 4. The same elements as those in FIG. 3 are assigned the same reference signs. The following description will focus on a difference from FIG. 3.

FIGS. 10 and 11 illustrate the flat drain slit 27 including two openings located at substantially the middle of the fin portion 21 in the air flow direction.

The flat drain slit 27 as an opening may have any shape other than a rectangle. Multiple flat drain slits 27 are provided such that a thin part of the fin portion 21 is located between the slits that are adjacent. In such a configuration, condensate water 4 can be guided by the thin part of the fin portion 21 and be drained. This results in enhanced drainage.

In the heat exchanger 10 according to Embodiment 4, the opening area of the flat drain slit 27 is greater than the total opening area of the first heat transfer promoter group 25A. The corrugated fin 2 includes the fin portions 21 arranged vertically. In the corrugated fin 2, therefore, the condensate water 4 guided from the first heat transfer promoter group 25A and the second heat transfer promoter group 25B of an upper fin portion 21 can be drained through the flat drain slit 27 of a lower fin portion 21. This results in enhanced drainage from the heat exchanger 10.

Embodiment 5

Figure 12:
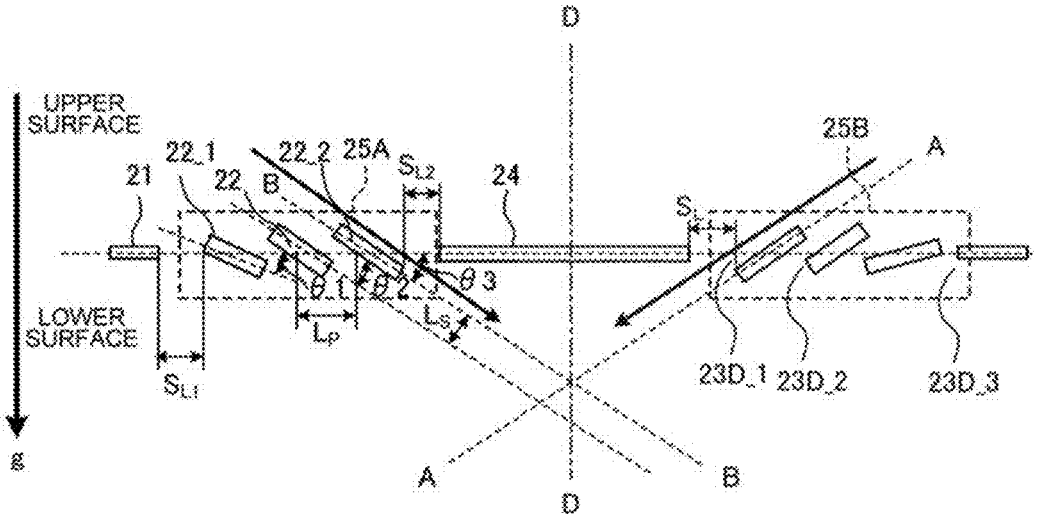
FIG. 12 is a sectional side view of a fin portion of a corrugated fin in Embodiment 5.

FIG. 12 is a sectional side view of a fin portion 21 of a corrugated fin 2 in Embodiment 5. The same elements as those in FIG. 4 are assigned the same reference signs. The following description will focus on differences from FIG. 4.

In a heat exchanger 10 according to Embodiment 5, an inclination angle θ of a louver part 22 relative to the flat surface of the fin portion 21 differs from an inclination angle θ of the next louver part 22 in the air flow direction. In FIG. 12, let θ1 denote a an inclination angle of the first louver part 22_1 relative to the fin part 21, let θ2 denote an inclination angle of the louver part 22 relative to the fin part 21 louver part 22, and let θ3 denote an inclination angle of the second louver part 22_2 relative to the fin part 21. In Embodiment 5, $\theta 1<\theta 2<\theta 3$ holds.

Specifically, the inclination angle θ1, the inclination angle θ2, and the inclination angle θ3 in the first heat transfer promoter group 25A differ from each other. The slope θ3 of the second louver part 22_2 in the first heat transfer promoter group 25A is larger than the inclination angle θ1 of the first louver part 22_1.

A slope θ1, an inclination angle θ2, and an inclination angle θ3 in the second heat transfer promoter group 25B differ from each other. The slope θ3 of the second louver part 22_2 in the second heat transfer promoter group 25B is larger than the inclination angle θ1 of the first louver part 22_1.

In the heat exchanger 10 according to Embodiment 5, the inclination angle θ3 of the second louver part 22_2 located downstream in the air flow direction is larger than the inclination angle θ1 of the first louver part 22_1 located upstream in the air flow direction. This reduces in heat transfer coefficient in an upstream region, where a large amount of frost can be formed, in the air flow direction. This results in improved resistance to frost.

Embodiment 6

Figure 13:
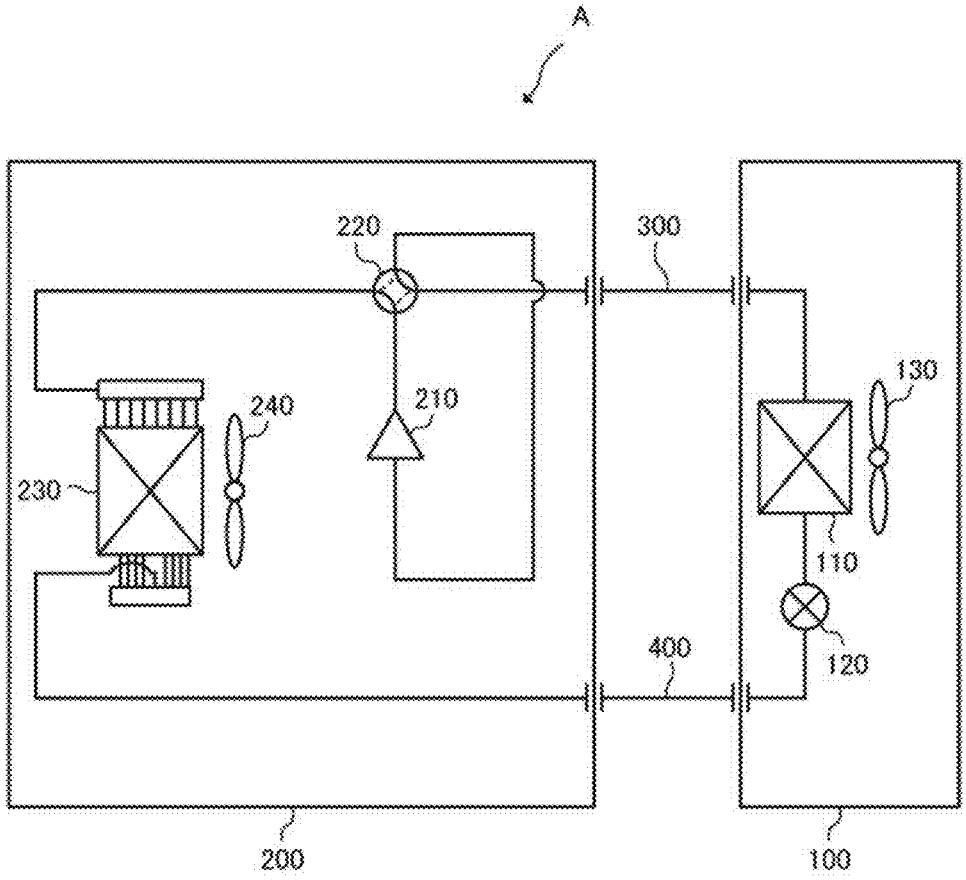
FIG. 13 is a diagram illustrating the configuration of an air-conditioning apparatus according to Embodiment 6.

FIG. 13 is a diagram illustrating the configuration of an air-conditioning apparatus A according to Embodiment 6. In Embodiment 6, the air-conditioning apparatus A will be described as an exemplary refrigeration cycle apparatus. In the air-conditioning apparatus A of FIG. 13, the heat exchanger 10 is used as an outdoor heat exchanger 230. The use of the heat exchanger 10 is not limited to this example. The heat exchanger 10 may be used as an indoor heat exchanger 110. The heat exchanger 10 may be used as each of the outdoor heat exchanger 230 and the indoor heat exchanger 110.

As illustrated in FIG. 13, the air-conditioning apparatus A includes an outdoor unit 200 and an indoor unit 100, which are connected by a gaseous refrigerant pipe 300 and a liquid refrigerant pipe 400 to form a refrigerant circuit. The outdoor unit 200 includes a compressor 210, a four-way valve 220, the outdoor heat exchanger 230, and an outdoor fan 240. The air-conditioning apparatus A according to Embodiment 1 includes the single outdoor unit 200 and the single indoor unit 100 connected by the pipes.

The compressor 210 sucks, compresses, and discharges the refrigerant. The compressor 210 is, but not particularly limited to, a compressor whose capacity can be varied by changing its operating frequency to any value through, for example, an inverter circuit. The four-way valve 220 is a valve that switches the flow of refrigerant between, for example, a cooling operation and a heating operation.

The outdoor heat exchanger 230 exchanges heat between the refrigerant and outdoor air. For example, in the heating operation, the outdoor heat exchanger 230 operates as an evaporator to evaporate and gasify the refrigerant. In the cooling operation, the outdoor heat exchanger 230 operates as a condenser to condense and liquify the refrigerant. The outdoor fan 240 sends the outdoor air to the outdoor heat exchanger 230 to promote heat exchange in the outdoor heat exchanger 230.

The indoor heat exchanger 110 exchanges heat between the refrigerant and air in, for example, a room to be air-conditioned. In the heating operation, the indoor heat exchanger 110 operates as a condenser to condense and liquify the refrigerant. In the cooling operation, the indoor heat exchanger 110 operates as an evaporator to evaporate and gasify the refrigerant.

The indoor unit 100 includes the indoor heat exchanger 110, an expansion valve 120, and an indoor fan 130. The expansion valve 120, such as an expansion device, reduces the pressure of the refrigerant to expand the refrigerant. Assuming that the expansion valve 120 is, for example, an electronic expansion valve, its opening degree is adjusted based on an instruction from a controller (not illustrated), for example. The indoor heat exchanger 110 exchanges heat between the refrigerant and the air in the room, which is an air-conditioned space. For example, in the heating operation, the indoor heat exchanger 110 operates as a condenser to condense and liquify the refrigerant. In the cooling operation, the indoor heat exchanger 110 operates as an evaporator to evaporate and gasify the refrigerant. The indoor fan 130 causes the air in the room to pass through the indoor heat exchanger 110, and supplies the air that has passed through the indoor heat exchanger 110 to the room.

Operations of the devices included in the air-conditioning apparatus A will now be described based on the flow of refrigerant. The operations of the devices in the refrigerant circuit in the heating operation will first be described based on the flow of refrigerant. High-temperature, high-pressure gaseous refrigerant compressed and discharged by the compressor 210 passes through the four-way valve 220 and then flows into the indoor heat exchanger 110. While passing through the indoor heat exchanger 110, the gaseous refrigerant exchanges heat with, for example, the air in the air-conditioned space, and thus condenses and liquifies. The refrigerant that has condensed and liquified passes through the expansion valve 120. The refrigerant is reduced in pressure when passing through the expansion valve 120. The refrigerant, reduced in pressure by the expansion valve 120, in a two-phase gas-liquid state passes through the outdoor heat exchanger 230. In the outdoor heat exchanger 230, the refrigerant exchanges heat with outdoor air sent from the outdoor fan 240 and thus evaporates and gasifies. The refrigerant then passes through the four-way valve 220 and is sucked into the compressor 210 again. The refrigerant is circulated through the air-conditioning apparatus A in the above-described manner, thus performing air-conditioning for heating.

The cooling operation will now be described. High-temperature, high-pressure gaseous refrigerant compressed and discharged by the compressor 210 passes through the four-way valve 220 and then flows into the outdoor heat exchanger 230. The refrigerant passes through the outdoor heat exchanger 230 and exchanges heat with outdoor air supplied by the outdoor fan 240 and thus condenses and liquifies. The refrigerant then passes through the expansion valve 120. The refrigerant is reduced in pressure when passing through the expansion valve 120. The refrigerant, reduced in pressure by the expansion valve 120, in a two-phase gas-liquid state passes through the indoor heat exchanger 110. In the indoor heat exchanger 110, the refrigerant exchanges heat with, for example, air in the air-conditioned space and thus evaporates and gasifies. The refrigerant then passes through the four-way valve 220 and is sucked into the compressor 210 again. The refrigerant is circulated through the air-conditioning apparatus A in the above-described manner, thus performing air-conditioning for cooling.

As described above, in the heat exchanger 10 operating as an evaporator, the surfaces of the flat heat transfer tubes 1 and the corrugated fins 2 are at a temperature lower than that of the air passing through the heat exchanger 10. Therefore, moisture in the air is converted to water droplets on the surfaces of the flat heat transfer tubes 1 and the corrugated fins 2, thus causing deposition of condensate water 4. When the air has a lower temperature, the temperatures of the surfaces of the fins drop to or below the freezing point of water, so that the condensate water 4 on the surfaces of the fins freezes into frost. The frost grows to block air flows, causing an increase in air passage resistance. This reduces the amount of air flowing through the heat exchanger 10, resulting in lower performance of the heat exchanger 10.

The air-conditioning apparatus A according to Embodiment 6 includes the heat exchanger 10 according to any of Embodiment 1, Embodiment 2, Embodiment 3, Embodiment 4, and Embodiment 5. Therefore, the heat exchanger 10 can reduce accumulation of the condensate water 4 and thus exhibit enhanced drainage performance. In addition, the first drain spaces 23D_1 and the third drain spaces 23D_3 increase a frost retention region. This can prolong the time it takes for frost to block an air flow between the fin portions 21, resulting in improved resistance to frost. Thus, the heat exchanger 10 of the air-conditioning apparatus A according to Embodiment 6 can reduce a decrease in heat transfer area of the corrugated fins 2 under frost formation conditions, thus reducing a decrease in heat transfer performance.

In Embodiment 1, Embodiment 2, Embodiment 3, Embodiment 4, Embodiment 5, and Embodiment 6, the louver part 22 is also referred to as a heat transfer promoter, and the flat drain slit 27 is also referred to as a fourth drain space.

REFERENCE SIGNS LIST

1: flat heat transfer tube, 2: corrugated fin, 2A: top portion, 2B: end portion, 3A: lower header, 3B: upper header, 4: condensate water, 10: heat exchanger, 21: fin portion, 22: louver part, 22_1: first louver part, 22_2: second louver part, 23D_1: first drain space, 23D_2: second drain space, 23D_3: third drain space, 25A: first heat transfer promoter group, 25B: second heat transfer promoter group, 26_1: first sloping part, 26_2: second sloping part, 27: flat drain slit, 100: indoor unit, 110: indoor heat exchanger, 120: expansion valve, 130: indoor fan, 200: outdoor unit, 210: compressor, 220: four-way valve, 230: outdoor heat exchanger, 240: outdoor fan, 300: gaseous refrigerant pipe, 400: liquid refrigerant pipe, A: air-conditioning apparatus, $S_L$: drain-space dimension, Ss: dimension of the flat drain slit, $L_L$: distance between a lower end, located on a lower surface of the fin portion, of one of adjacent louver parts and an upper end, located on an upper surface of the fin portion, of the other louver part in a direction along the fin portion, $L_s$: distance of a gap between the louver parts 22, $A_1$: opening areas defined by multiple louver parts in the first heat transfer promoter group, $B_1$: opening areas defined by multiple louver parts in the second heat transfer promoter group, θ: inclination angle

The invention claimed is:

1. A heat exchanger comprising:

a plurality of heat transfer tubes spaced in a direction orthogonal to an air flow direction; and a corrugated fin disposed between the plurality of heat transfer tubes, the corrugated fin including a fin portion defining a flat surface and one or more heat transfer promoter groups each including a plurality of heat transfer promoters louver parts, the plurality of louver parts extending from one of the plurality of heat transfer tubes that are adjacent to an other one of the plurality of heat transfer tubes that are adjacent and sloping relative to the fin portion, wherein the plurality of louver parts include a first louver part disposed most upstream in the air flow direction, a first drain space having a shape in which a part of a perimeter thereof is defined by an edge of the first louver part and is open at upstream side of the first louver part in the air flow direction when viewed in a direction perpendicular to the fin portion is provided between the first louver part and an air upstream part of the fin portion that is located closest to and upstream of the first louver part in the air flow direction, a second drain space is provided between adjacent ones of the louver parts, and the first drain space has a larger area than the second drain space when viewed in a direction perpendicular to the fin portion.

2. The heat exchanger of claim 1, wherein the plurality of louver parts include a second louver part disposed most downstream in the air flow direction, a third drain space, having a shape in which a part of a perimeter thereof is defined by an edge of the second louver part and is open at upstream in the air of the first louver part when viewed in the direction perpendicular to the fin portion is provided between the second louver part and a downstream part of the fin portion that is located closest to and downstream of the second louver part in the air flow direction, and the third drain space has a larger area than the second drain space when viewed in the direction perpendicular to the fin portion.

3. The heat exchanger of claim 2, wherein a distance between the first louver part and the air upstream part of the fin portion located closest to and upstream of the first louver part in the air flow direction is longer than a distance between the louver parts that are adjacent, and a distance between the second louver part and the downstream part of the fin portion located closest to and downstream of the second louver part in the air flow direction is longer than the distance between the louver parts that are adjacent.

4. The heat exchanger of claim 2, wherein the area of the first drain space is larger than the area of the third drain space when viewed in the direction perpendicular to the fin portion.

5. The heat exchanger of claim 4, wherein the one or more heat transfer promoter groups include a first heat transfer promoter group and a second heat transfer promoter group located downstream of the first heat transfer promoter group in the air flow direction, and a sum of the areas of the first drain space, second drain space, and third drain space in the first heat transfer promoter group is greater than a sum of the areas of the first, second, and third drain spaces in the second heat transfer promoter group when viewed in the direction perpendicular to the fin portion.

6. The heat exchanger of claim 2, wherein between the air upstream part of the fin portion located closest to and upstream of the first louver part in the air flow direction and the first louver parts is provided a first sloping part sloping parallel to a sloping direction of the first heat transfer promoter and protruding from a flat surface of the fin, and between the downstream part of the fin portion located closest to and downstream of the second louver part in the air flow direction and the second louver part is provided a second sloping part sloping parallel to the sloping direction of the first heat transfer promoter and protruding to a flat surface of the fin.

7. The heat exchanger of claim 5, wherein a fourth drain space extending through the fin portion is provided in a part of the fin portion that is located between the first heat transfer promoter group and the second heat transfer promoter group.

8. The heat exchanger of claim 7, wherein the fourth drain space has an opening area greater than the sum of the areas of the first drain space, second drain space, and third drain space in the first heat transfer promoter group when viewed in the direction perpendicular to the fin portion.

9. The heat exchanger of claim 7, wherein the fourth drain space comprises a plurality of openings arranged in the air flow direction.

10. The heat exchanger of claim 5, wherein the plurality of louver parts in the first heat transfer promoter group slope relative to the fin portion in a direction opposite to a direction in which the plurality of louver parts in the second heat transfer promoter group slope relative to the fin portion.

11. The heat exchanger of claim 2, wherein an inclination angle of the second louver part relative to the fin portion is larger than an inclination angle of the first louver part relative to the fin portion.

12. The heat exchanger of claim 1, wherein an edge of the fin portion or the louver part that defines the first drain space includes a curve, and the curve includes a top portion at a midpoint between the plurality of heat transfer tubes that are adjacent and protrudes in the air flow direction or a direction opposite to the air flow direction.

13. The heat exchanger of claim 1, wherein the corrugated fin includes a plurality of fin portions including the fin portion and a curved top portion located between the plurality of fin portions that are adjacent, and has an undulating shape as a whole such that the plurality of fin portions are arranged in a direction along axes of the plurality of heat transfer tubes.

14. An air-conditioning apparatus comprising:

the heat exchanger of claim 1.

* * * * *